US011480191B2

(12) United States Patent
Fizer et al.

(10) Patent No.: US 11,480,191 B2
(45) Date of Patent: Oct. 25, 2022

(54) BLADE RETENTION SYSTEM FOR OVERHEAD FAN

(71) Applicant: DELTA T, LLC, Lexington, KY (US)

(72) Inventors: Jason H. Fizer, Lexington, KY (US); Michael S. Fay, Lexington, KY (US); Matthew Mattingly, Lexington, KY (US); Richard W. Fizer, Lexington, KY (US)

(73) Assignee: DELTA T, LLC, Lexington, KY (US)

( * ) Notice: Subject to any disclaimer, the term of this patent is extended or adjusted under 35 U.S.C. 154(b) by 0 days.

(21) Appl. No.: 17/031,065

(22) Filed: Sep. 24, 2020

(65) Prior Publication Data

US 2021/0088053 A1 Mar. 25, 2021

Related U.S. Application Data

(60) Provisional application No. 62/905,042, filed on Sep. 24, 2019.

(51) Int. Cl.

| | |
|---|---|
| ***F04D 29/34*** | (2006.01) |
| ***F04D 25/08*** | (2006.01) |
| ***F04D 29/38*** | (2006.01) |
| ***F04D 19/00*** | (2006.01) |

(52) U.S. Cl.
CPC ..... *F04D 29/34* (2013.01); *F04D 19/002* (2013.01); *F04D 25/088* (2013.01); *F04D 29/388* (2013.01)

(58) Field of Classification Search
CPC ..... F04D 25/088
See application file for complete search history.

(56) References Cited

U.S. PATENT DOCUMENTS

| | | | | |
|---|---|---|---|---|
| 5,542,819 | A | 8/1996 | Bucher et al. | |
| 6,244,821 | B1 | 6/2001 | Boyd et al. | |
| 6,939,108 | B2 | 9/2005 | Boyd | |
| 7,252,478 | B2 | 8/2007 | Aynsley | |
| 7,284,960 | B2 | 10/2007 | Aynsley | |
| D587,799 | S | 3/2009 | Oleson | |
| 8,770,937 | B2 | 7/2014 | Fizer et al. | |
| 9,347,462 | B2 | 5/2016 | Fizer et al. | |
| 9,726,192 | B2 * | 8/2017 | Whitley | B29C 44/1271 |
| 10,816,010 | B2 * | 10/2020 | Horng | F04D 25/088 |
| 2008/0008596 | A1 | 1/2008 | Aynsley | |
| 2008/0014090 | A1 | 1/2008 | Aynsley et al. | |
| 2008/0037264 | A1 * | 2/2008 | Bennett | F04D 25/088 362/386 |
| 2009/0072108 | A1 | 3/2009 | Oleson | |
| 2009/0081045 | A1 | 3/2009 | Scherer et al. | |
| 2009/0208333 | A1 | 8/2009 | Smith et al. | |
| 2010/0104461 | A1 | 4/2010 | Smith et al. | |
| 2010/0278637 | A1 | 11/2010 | Oleson et al. | |

* cited by examiner

*Primary Examiner* — Ninh H. Nguyen
*Assistant Examiner* — John S Hunter, Jr.
(74) *Attorney, Agent, or Firm* — Dickinson Wright PLLC; Andrew D. Dorisio

(57) ABSTRACT

A fan includes a motor, a rotatable hub coupled to the motor, and at least one fan blade. The at least one fan blade includes a first end coupled to the rotatable hub, a second end, a leading edge, a trailing edge, a passage extending from the first end to the second end, and a winglet attached to the second end. At least one flexible strap extends through the passage of the at least one fan blade. The flexible strap is coupled at a first end to the rotatable hub and coupled at a second end to the winglet, such as to an inner portion thereof within the passage.

12 Claims, 9 Drawing Sheets

BLADE RETENTION SYSTEM FOR OVERHEAD FAN

This application claims the benefit of U.S. Provisional Patent Application Ser. No. 62/905,042, filed Sep. 24, 2019, the disclosure of which is incorporated herein by reference. This application is related to U.S. Pat. Nos. 8,770,937 and 9,347,462, the disclosures of which are incorporated herein by reference.

TECHNICAL FIELD

This document relates generally to the fan art and, more particularly, to an overhead fan, such as a ceiling-mounted fan, including a blade retention system.

BACKGROUND

Overhead fans such as ceiling-mounted fans are in widespread use. Such fans are often designed with certain features to retain associated fan blades and prevent inadvertent detachment during operation. For example, the fan blades may be attached to a rotatable hub via various retainers, including tabs associated with the hub and by fasteners, such as rivets.

In addition to attaching the fan blades to the hub in this manner, enhancements may be used to act as an additional safeguard in the event of failure or fatigue. For example, it is further known to provide systems for the retention of fan blades in the event of a failure of the fan blade or other modes of attachment. Merely exemplary systems are described in U.S. Pat. No. 9,347,462 for "Fan Blade Retention System," issued May 24, 2016 (incorporated herein by reference), and U.S. Pat. No. 8,770,937 for "Fan Blade Retention System," issued Jul. 8, 2014.

While such fan blade retention systems are known, a need exists for a more efficient fan blade retention system that decreases the weight and otherwise provides an arrangement that is simple to implement, yet highly effective in use.

SUMMARY

A first aspect of the disclosure pertains to an apparatus, comprising (a) a motor; (b) a rotatable hub coupled to the motor; (c) at least one fan blade comprising: i. a first end coupled to the rotatable hub, ii. a second end, iii. a leading edge, iv. a trailing edge, v. a passage extending from the first end to the second end, and vi. a winglet attached to the second end; and (d) at least one flexible strap extending through the passage of the at least one fan blade, and wherein the at least one flexible strap is coupled at a first end to the rotatable hub and coupled at a second end to the winglet.

In one embodiment, the winglet includes an anchor for coupling to the flexible strap within the passage. The anchor may be configured to fit around an exterior of the one fan blade. The anchor may further include an extension configured to fit around the exterior. The extension may extend from an inside face of the winglet, substantially parallel to a longitudinal axis of the flexible strap. The extension may be configured to form an anchor point for the flexible strap at the second end. At least one fastener passes through the anchor point in a direction generally transverse to a longitudinal axis of the at least one fan blade.

The hub may include an anchor configured to provide an attachment point for the flexible strap at the first end. The anchor may include a threaded insert. At least one fastener may pass through the threaded insert in a direction generally transverse to a longitudinal axis of the fan blade. The flexible strap may have a first mount attached to a first end and a second mount bracket attached to a second end.

The apparatus may include a plurality of fan blades having passages coupled to the rotatable hub and a plurality of flexible straps. Each flexible strap is located in the passage of one of the plurality of fan blades. Each flexible strap is coupled at a first end to the rotatable hub and coupled at a second end to an extension of the winglet within the passage.

A further aspect of the disclosure pertains to an apparatus for connecting with a fan blade of a fan. The apparatus comprises a winglet configured to couple with the fan blade. The winglet includes an extension configured to connect with a connector to secure a first end of the fan blade to the fan.

In one embodiment, the extension extends from an inner portion of the winglet. The extension may be connected to the winglet by at least one fastener. A fan may include a plurality the foregoing apparatuses.

Still a further aspect of the disclosure relates to an apparatus for a fan including a motor and a rotatable hub rotatably coupled to the motor. The apparatus comprises a plurality of fan blades, each fan blade of the plurality of fan blades having a passage extending from a first end of the fan blade to a second end of the fan blade. A winglet is attached to the second end of each fan blade. At least one connector extends through the passage of each fan blade and coupled to the winglet within the passage.

The connector comprises a flexible strap attached to an inner portion of the winglet. The flexible strap may be attached to the inner portion of the winglet by a removable fastener.

BRIEF DESCRIPTION OF THE DRAWINGS

The accompanying drawings incorporated in and forming a part of the specification, illustrate several aspects of this disclosure, and together with the description serve to explain the principles of the disclosure. In the drawings.

DETAILED DESCRIPTION

In the following detailed description, reference is made to the accompanying drawings that form a part hereof, and in which is shown by way of illustration, specific embodiments in which the invention may be practiced. These embodiments are described in sufficient detail to enable those skilled in the art to practice the embodiments and like numerals represent like details in the various figures. Also, it is to be understood that other embodiments may be utilized, and that process or other changes may be made without departing from the scope of the disclosure. The following detailed description is not to be taken in a limiting sense, and the scope of the invention is defined only by the appended claims and their equivalents. In accordance with the disclosure, a blade retention system for a fan is provided.

Figure 1:
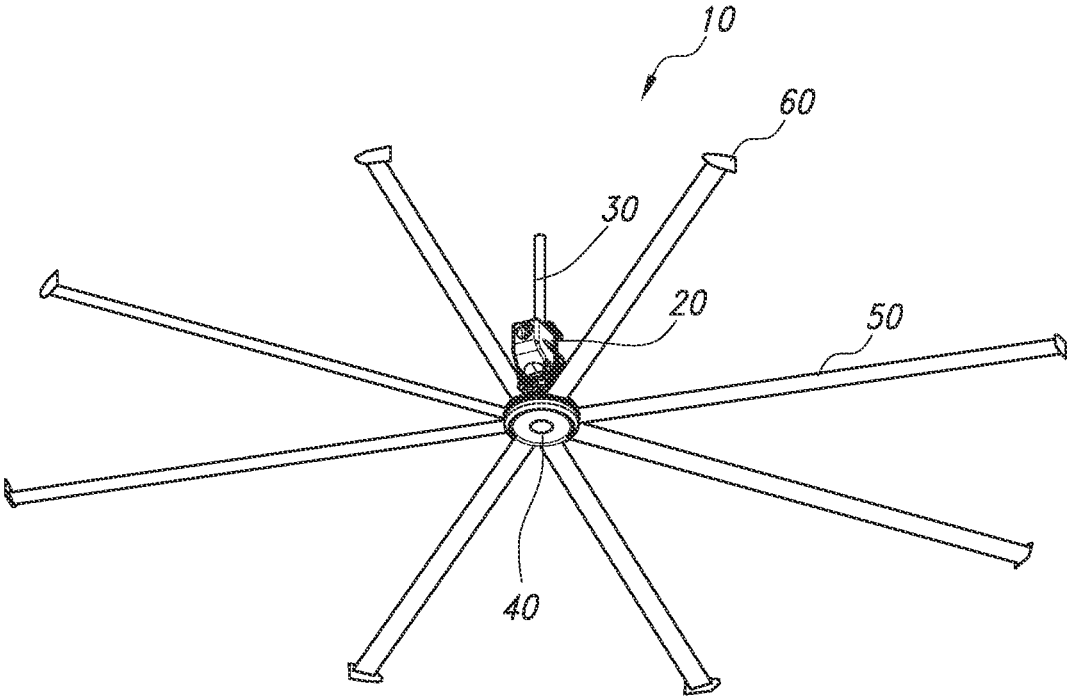
FIG. 1 is a perspective view of an exemplary fan having a motor, a hub, a support and a plurality of fan blades forming one aspect of this disclosure.
Figure 2:
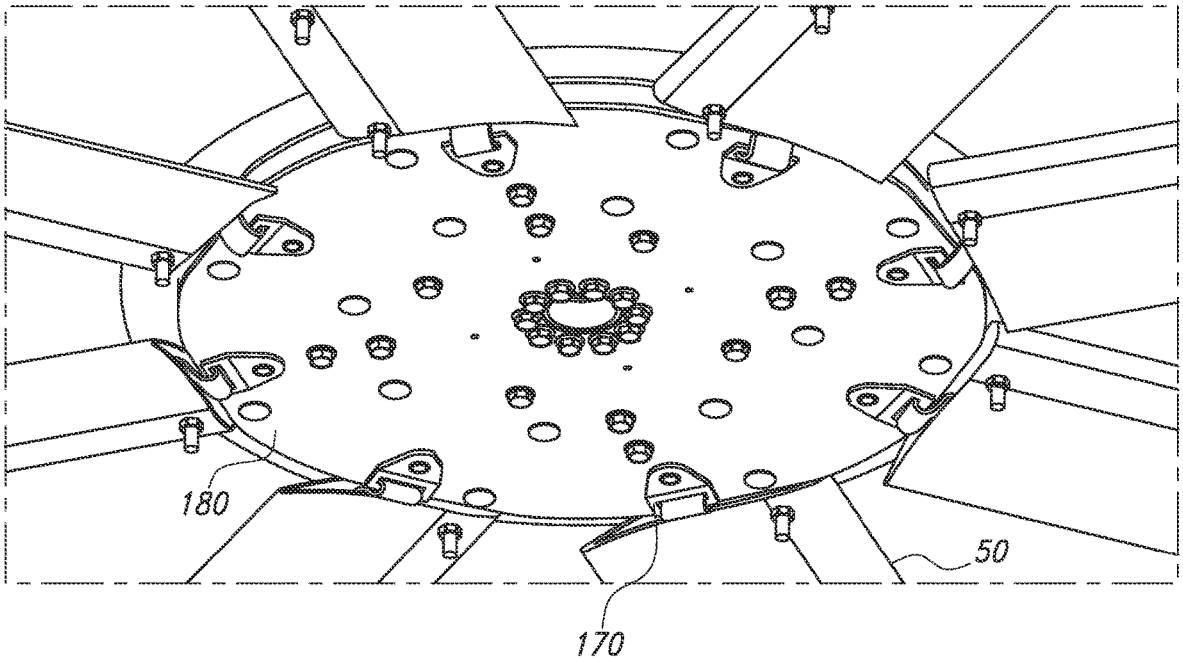
FIG. 2 is a partial bottom perspective view of an exemplary fan with the hub covering removed to illustrate a plurality of connectors or cables, each in the form of flexible webbing or strap, forming one aspect of this disclosure.

As shown in FIG. 1, a fan (10) includes a motor (20), a support (30), a rotatable hub (40) and a plurality of fan blades (50) having a winglet (60) at its distal or free end. The support (30) is configured to be coupled to a surface or other structure at a first end such that fan (10) is substantially attached to the surface or other structure. The support (30) of the illustrated embodiment comprises an elongated tubular structure that couples the fan (10) to a ceiling, though it should be understood that the support (30) may be constructed and/or configured in a variety of other suitable ways as will be apparent to one of ordinary skill in the art in view of the teachings herein. By way of example only, support (30) need not be coupled to a ceiling or other overhead structure, and instead may be coupled to a wall or to the ground. For instance, support (30) may be positioned on the top of a post that extends upwardly from the ground. Alternatively, support (30) may be mounted in any other suitable fashion at any other suitable location. By way of example only, support (30) may be configured in accordance with the teachings of U.S. Pat. Pub. No. 2009/0072108, entitled "Ceiling Fan with Angled Mounting," published Mar. 19, 2009, the disclosure of which is incorporated by reference herein.

The motor (20) may comprise an AC induction motor having a drive shaft, though it should be understood that motor (20) may alternatively comprise any other suitable type of motor (e.g., a permanent magnet brushless DC motor, a brushed motor, an inside-out motor, etc.). In the present example, motor (20) is fixedly coupled to support (30) and rotatably coupled to hub (40). Furthermore, motor (20) is operable to rotate hub (40) and the plurality of fan blades (50). By way of example only, motor (20) may be constructed in accordance with at least some of the teachings of U.S. Pat. Pub. No. 2009/0208333, entitled "Ceiling Fan System with Brushless Motor," published Aug. 20, 2009, the disclosure of which is incorporated by reference herein. Furthermore, fan (10) may include control electronics that are configured in accordance with at least some of the teachings of U.S. Pat. Pub. No. 2010/0278637, entitled "Ceiling Fan with Variable Blade Pitch and Variable Speed Control," published Nov. 4, 2010, the disclosure of which is incorporated by reference herein.

Figure 6:
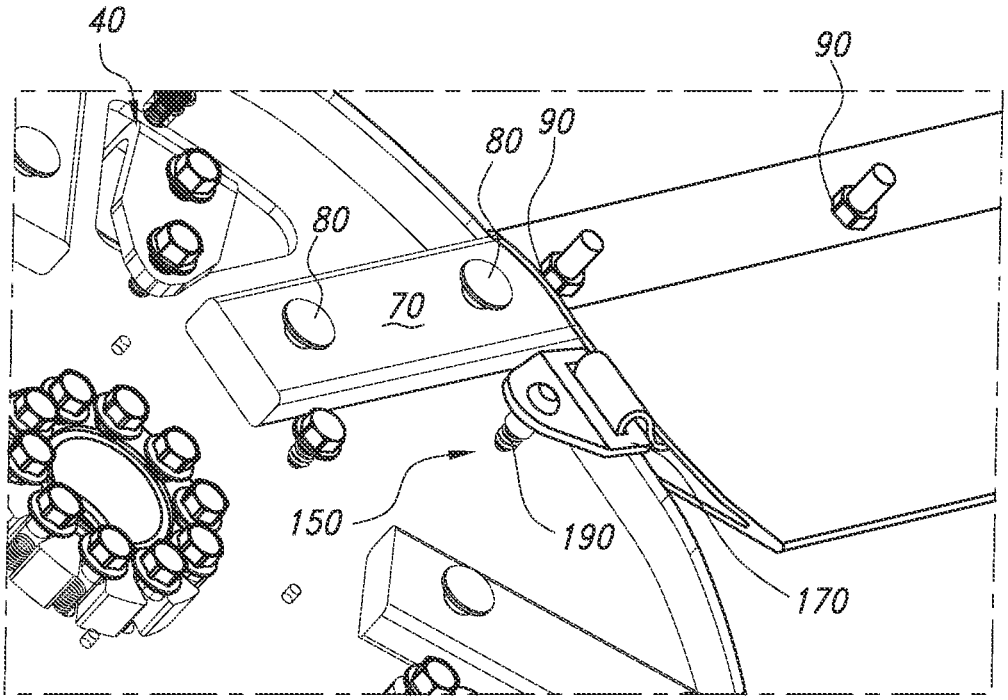
FIG. 6 is a partial bottom perspective view of the hub and fan blade illustrating the attachment of the tab to the hub and fan blade forming one aspect of this disclosure.

As perhaps best illustrated in FIG. 6, hub (40) of the present example comprises a plurality of radially outwardly extending arms or tabs (70). Tabs (70) may be provided in accordance with at least some of the teachings of U.S. Pat. Pub. No. 2010/0278637, entitled "Ceiling Fan with Variable Blade Pitch and Variable Speed Control," published Nov. 4, 2010, the disclosure of which is incorporated by reference herein. Each tab (70) is shown attached to the hub (40) via bolts (80) or other fastening members. Each tab (70) further includes a plurality of mounting holes (90) such that fan blades (50) are fixedly coupled to each corresponding tab (70) and such that fan blades (50) rotate unitarily with hub (40).

In the present example, fan blades (50) are shown mounted to tabs (70) by fasteners, such as bolts or screws, though it should be understood that alternative mounting arrangements may be employed. For example, fan blades (50) may be mounted by adhesives, by friction fit, and/or by any combination of suitable mountings as will be apparent to one of ordinary skill in the art in light of the teachings herein. It should also be understood that an interface component (not shown) may be provided at the interface of each fan blade (50) and hub (40). By way of example only, such an interface component may be configured in accordance with the teachings of U.S. Pat. Pub. No. 2009/0081045, entitled "Aerodynamic Interface Component for Fan Blade," published Mar. 26, 2009, the disclosure of which is incorporated by reference herein. Hub (40) is further secured to the drive shaft of motor (20) (as shown in FIG. 1) such that hub (40) and the drive shaft rotate unitarily.

Figure 4A:
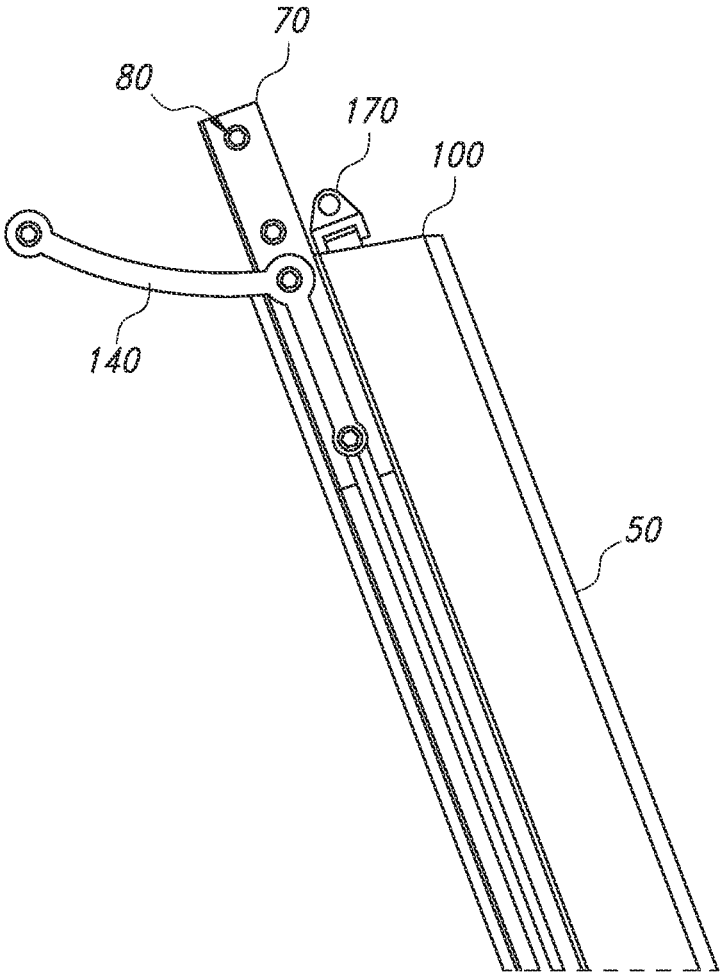
FIG. 4*a* is a partial top view of the proximal end of the fan blade forming one aspect of this disclosure.
Figure 4B:
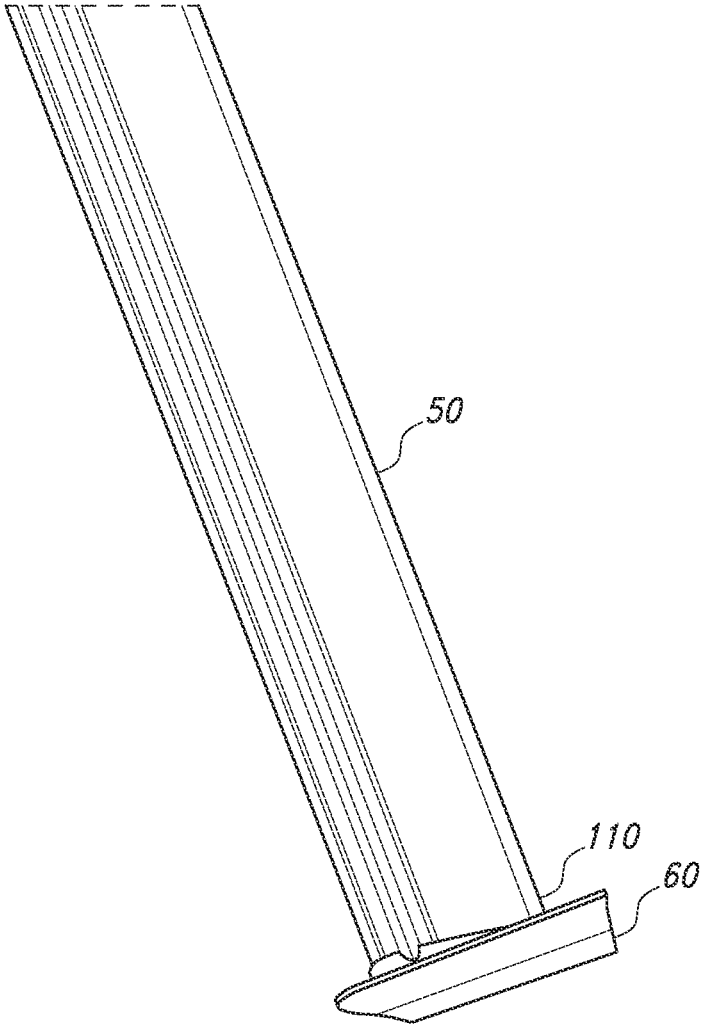
FIG. 4*b* is a partial top view of the distal or free end of the fan blade forming one aspect of this disclosure.
Figure 7A:
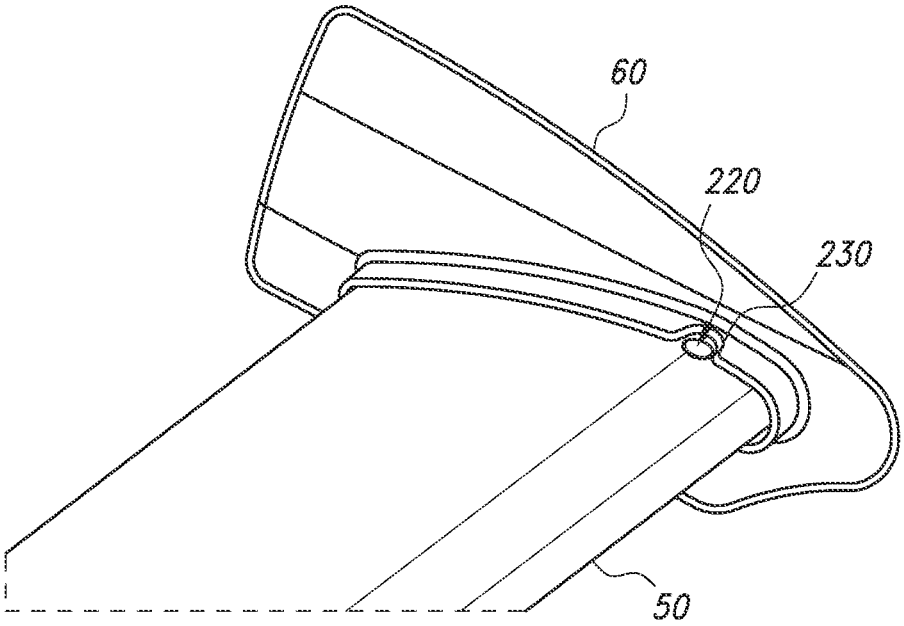
FIG. 7*a* is partial perspective view of a winglet attached to the fan blade forming one aspect of this disclosure.
Figure 7B:
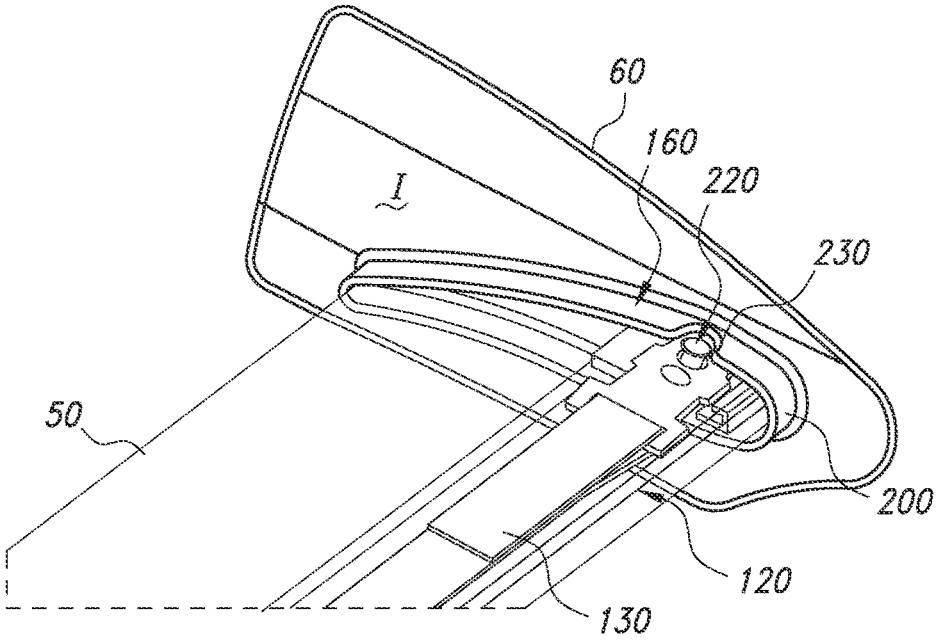
FIG. 7*b* is another partial perspective view of the winglet attached to the fan blade with the fan blade being transparent to illustrate the cable forming one aspect of this disclosure.

As shown in FIGS. 4*a* and 4*b*, an exemplary fan blade (50) comprises a first or proximal end (100) and a second or distal or free end (110). Each fan blade (50) is coupled to hub (40) (as seen in FIG. 1) at the first end (100) and each fan blade (50) extends radially outwardly from hub (40). As shown in FIG. 7*b*, fan blades (50) further define at least one passage (120) extending through fan blade (50) from first end (100) to second end (110). The passage (120) is configured to receive a connector or cable in the form of a flexible strap (130), which may comprise a lightweight, but durable polymer material, such as for example Nylon webbing. As perhaps best seen in FIG. 7*c*, this webbing or strap (130) may extend through the at least one passage (120) from first end (100) to the second end (110).

Fan blades (50) may further be constructed in accordance with some or all of the teachings of any of the patents, patent publications, or patent applications cited herein. For example, fan blades (50) may be configured in accordance with the teachings of U.S. Pat. No. 7,284,960, entitled "Fan Blades," issued Oct. 23, 2007; U.S. Pat. No. 6,244,821, entitled "Low Speed Cooling Fan," issued Jun. 12, 2001; and/or U.S. Pat. No. 6,939,108, entitled "Cooling Fan with Reinforced Blade," issued Sep. 6, 2005. The disclosures of each of those U.S. patents are incorporated by reference herein. As another merely illustrative example, fan blades (50) may be configured in accordance with the teachings of U.S. Pat. Pub. No. 2008/0008596, entitled "Fan Blades," published Jan. 10, 2008, the disclosure of which is also incorporated by reference herein. As yet another merely illustrative example, fan blades (50) may be configured in accordance with the teachings of U.S. Pat. Pub. No. 2010/0104461, entitled "Multi-Part Modular Airfoil Section and Method of Attachment Between Parts," published Apr. 29, 2010, the disclosure of which is incorporated by reference herein.

Figure 7C:
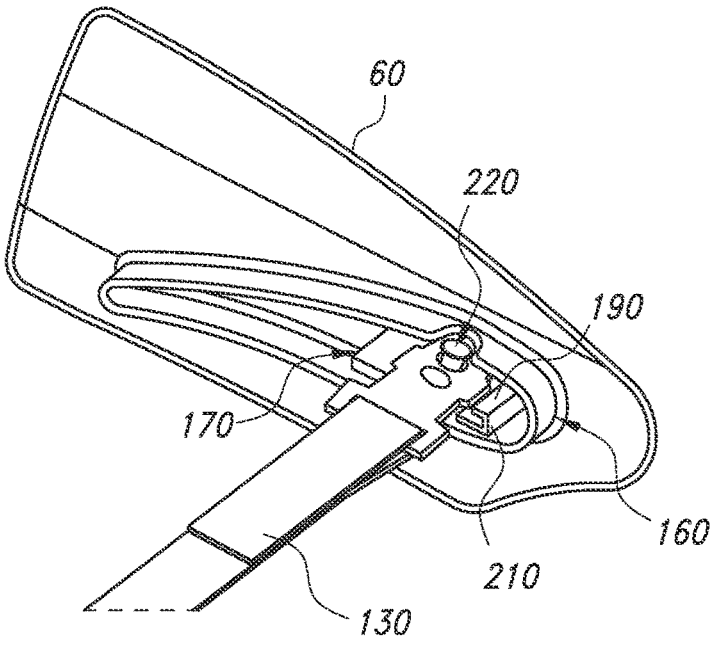
FIG. 7*c* is yet another partial perspective view of the winglet with the fan blade hidden forming one aspect of this disclosure.
Figure 8A:
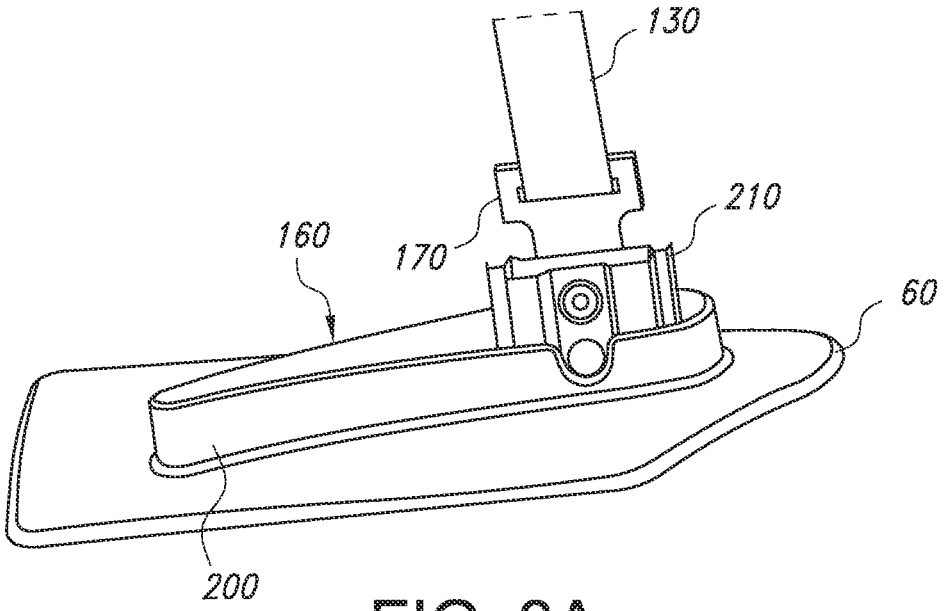
FIG. 8*a* is partial side perspective view of the winglet illustrating an outer anchor forming one aspect of this disclosure.
Figure 8B:
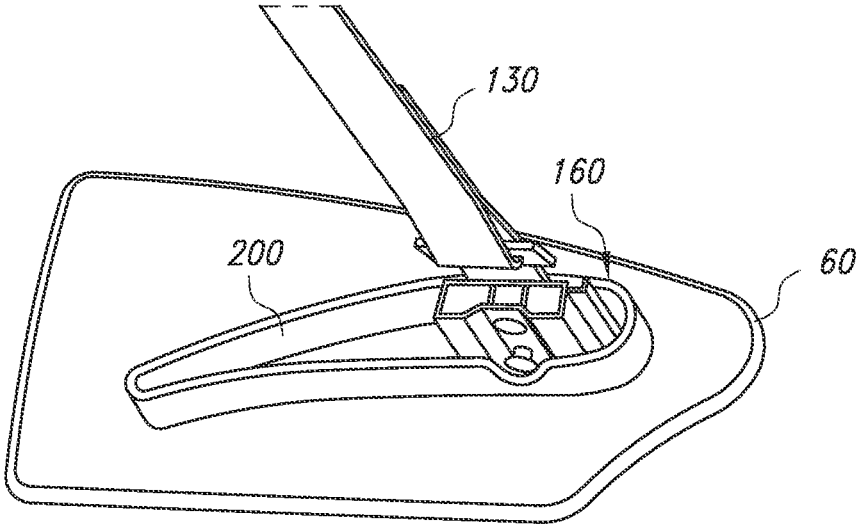
FIG. 8*b* is partial top perspective view of a winglet illustrating the outer anchor forming one aspect of this disclosure.

Fan blades (50) of the present example (which are sometimes termed "airfoils" in view of their cross-sectional shape) may further include a variety of modifications. By way of example only, each fan blade (50) further comprises a winglet (60) coupled to the second end (110) of fan blade (50) as illustrated in FIGS. 7*a*-7*c*. Each winglet (60) may be constructed in accordance with some or all of the teachings of any of the patents, patent publications, or patent applications cited herein. For instance, winglets (60) may be configured in accordance with at least some of the teachings of U.S. Pat. No. 7,252,478, entitled "Fan Blade Modifications," issued Aug. 7, 2007, the disclosure of which is incorporated by reference herein. As another merely illustrative example, winglet (60) may be configured in accordance with the teachings of U.S. Pat. Pub. No. 2008/0014090, entitled "Cuffed Fan Blade Modifications," published Jan. 17, 2008, the disclosure of which is incorporated by reference herein. As yet another merely illustrative example, winglet (60) may be configured in accordance with the teachings of U.S. Pat. No. D587,799, entitled "Winglet for a Fan Blade," issued Mar. 3, 2009, the disclosure of which is incorporated by reference herein. Of course, any other suitable configuration for winglet (60) may be used as will be apparent to those of ordinary skill in the art in light of the teachings herein.

As noted above, the fan (10) includes a hub (40) and a plurality of fan blades (50) that are attached to hub (40). The hub (40), in turn, is secured to motor (20). In some instances, redundant systems are used to provide for the retention of hub (40) and fan blades (50) in the event of a structural failure for part of fan (10). For instance, to prevent the inadvertent separation of hub (40) from motor (20), one or more attachments may be provided by means of which hub (40) will engage an additional part of motor (20) and/or support (30). Thus, in the event of a separation of the drive shaft from hub (40)—the primary attachment between hub (40) and motor (20)—the one or more safety attachments prevent the hub (40) from completely disconnecting relative to motor (20) and/or support (30). Some examples of such attachments are disclosed in the various references cited herein.

Figure 3:
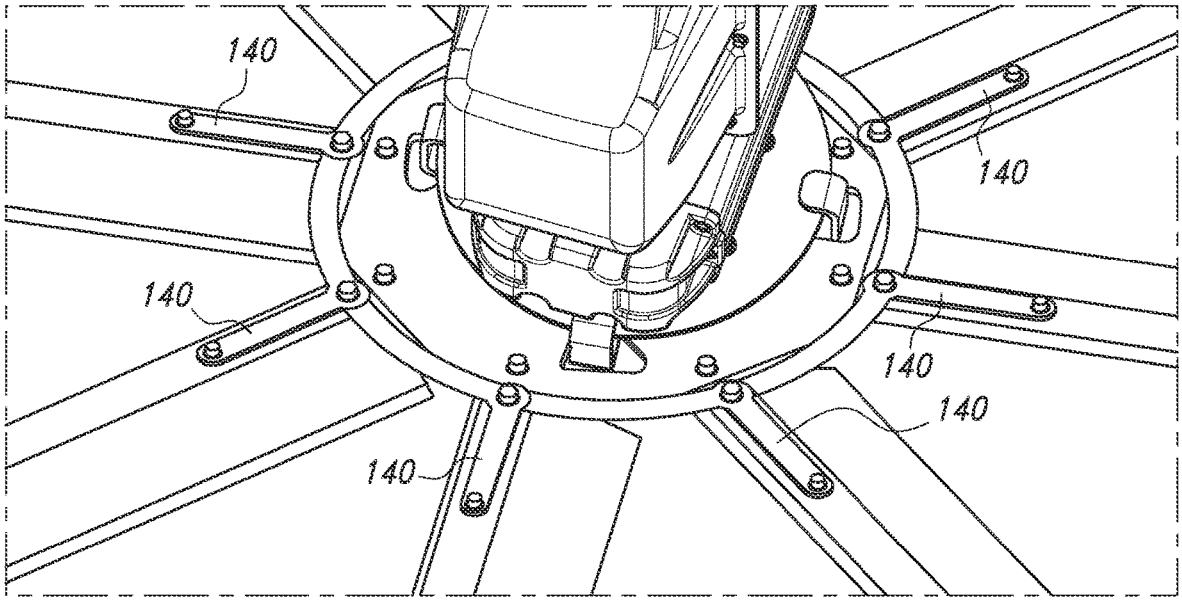
FIG. 3 is a partial top perspective view of an exemplary fan forming one aspect of this disclosure.
Figure 5:
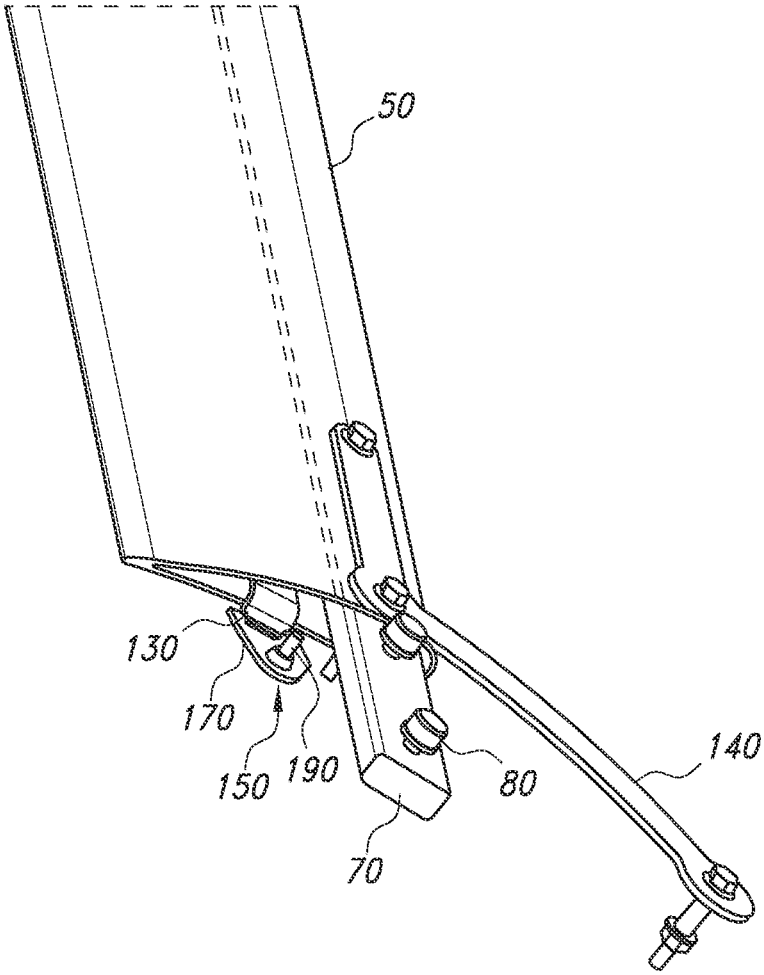
FIG. 5 is a partial perspective view of the fan blade including the cable, tab and fan blade attachment forming one aspect of this disclosure.

In addition or in the alternative, to prevent inadvertent separation of the plurality of fan blades (50) from hub (40), a plurality of fan blade attachments (140) (as shown in FIGS. 3, 4*a* and 5) may be provided that interconnect among the adjacent fan blades (50). Consequently, the plurality of fan blades (50) provide mutual support and attachment in the event of the separation of a single fan blade (50) from the corresponding tab (70) on hub (40). Again, some examples of such attachments are disclosed in the various references cited herein.

As shown in FIGS. 2, 5, 7*a*-7*c*, 8*a* and 8*b*, an additional system is provided for the retention of fan blades (50) onto the hub (40) in the event of a failure of both the attachment by tab (70) and the secondary attachment system of fan blade retainers (140) due to misuse of fan (10) by an operator of fan (10) or other factors. The system includes a first or inner anchor (150), which is positioned on the end of the fan blade (50) opposite the winglet (60), i.e., the proximal or non-free end of the fan blade (50). The system also includes a second or outer anchor (160) positioned within the winglet (60) at the distal or free end of the fan blade (50). Each connector or cable in the form of a flexible webbing or strap (130) includes a mounting bracket (170) attached onto each opposed end via sewing or other attachment means. For example, the mounting bracket (170) may have a slot or opening for the strap (130) to extend through and attached via sewing to form a sewn connection. The webbing or strap (130) is elongated, and attached to the inner anchor (150) as well as the outer anchor (160) associated with the winglet (60).

The inner anchor (150) is positioned below the hub (40) (including within any outer covering provided) and is attached to a hub plate (180). In the embodiment shown in FIG. 2 (wherein the outer covering is removed for illustrative purposes), the hub plate (180) is a lower of two spaced hub plates, but different configurations are possible. The inner anchor (150) includes an attachment point, such as by way of a threaded insert (190), corresponding to each strap (130). Each threaded insert (190) is installed into the hub plate (180) during assembly to provide the attachment point for the flexible webbing or strap (130) to be attached via a fastener, such as a screw or bolt, thus simplifying the manner of connection.

FIGS. 7*a*-7*c*, 8*a* and 8*b* show an exemplary fan blade (50) comprising a winglet (60) coupled to second end (110) of fan blade (50). Each winglet (60) has the outer anchor (160) including a radially projecting perimeter extension (200) and an inner extension (210). The perimeter extension (200) is configured to fit around and partially cover the outside or exterior of the corresponding fan blade (50). The perimeter extension (200) includes a cutout or arched recess (220) for receiving at least one screw or other fastener (230) that aids in anchoring the webbing or strap (130) to the winglet (60). The inner extension (210) extends from an inner surface, such as an inside face (I) of the winglet (60) and by way of the perimeter extension (200).

The inner extension (210) extends substantially parallel to a longitudinal axis of the strap (130) and functions as an anchor point for the webbing or strap (130). Specifically, as perhaps best shown in FIGS. 8*a* and 8*b*, the at least one screw or other fastener (230) (two fasteners are shown in this particular embodiment) pass transverse to the radial axis of the fan blades (50) and through corresponding holes in the mounting bracket (170) to anchor the strap (130) to the winglet (60). The flexible webbing or strap (130) is passed from the winglet (60) through the passage (120) of fan blade (50) to the inner anchor (150) on the hub (40) such that any need for a tensioning mechanism is eliminated. By forming the coupling between the inner extension (210) of the winglet (60) in the interior of the fan blade (50), there is no impact on aerodynamic performance or resulting increase in noise as the fan is operated.

Each of the following terms written in singular grammatical form: "a", "an", and the", as used herein, means "at least one", or "one or more". Use of the phrase "One or more" herein does not alter this intended meaning of "a", "an", or "the". Accordingly, the terms "a", "an", and "the", as used herein, may also refer to, and encompass, a plurality of the stated entity or object, unless otherwise specifically defined or stated herein, or the context clearly dictates otherwise. For example, the phrases: "a unit", "a device", "an assembly", "a mechanism", "a component, "an element", and "a step or procedure", as used herein, may also refer to, and encompass, a plurality of units, a plurality of devices, a plurality of assemblies, a plurality of mechanisms, a plurality of components, a plurality of elements, and, a plurality of steps or procedures, respectively.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated components), feature(s), characteristic(s), parameter(s), integer(s), or step(s), and does not preclude addition of one or more additional component(s), feature(s), characteristic(s), parameter(s), integer(s), step(s), or groups thereof. Each of these terms is considered equivalent in meaning to the phrase "consisting essentially of." Each of the phrases "consisting of" and "consists of, as used herein, means "including and limited to". The phrase "consisting essentially of" means that the stated entity or item (system, system unit, system sub-unit device, assembly, sub-assembly, mechanism, structure, component element or, peripheral equipment utility, accessory, or material, method or process, step or procedure, sub-step or sub-procedure), which is an entirety or part of an exemplary embodiment of the disclosed invention, or/and which is used for implementing an exemplary embodiment of the disclosed invention, may include at least one additional feature or characteristic" being a system unit system sub-unit device, assembly, sub-assembly, mechanism, structure, component or element or, peripheral equipment utility, accessory, or material, step or procedure, sub-step or sub-procedure), but only if each such additional feature or characteristic" does not materially alter the basic novel and inventive characteristics or special technical features, of the claimed item.

Terms of approximation, such as the terms about, substantially, approximately, generally, etc., as used herein, refer to ±10% of the stated numerical value or as close as possible to a stated condition.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub-combination in the context or format of a single embodiment may also be illustratively described and presented in the context or format of a plurality of separate embodiments.

Although the invention has been illustratively described and presented by way of specific exemplary embodiments, and examples thereof, it is evident that many alternatives, modifications, or/and variations, thereof, will be apparent to those skilled in the art. Accordingly, it is intended that all such alternatives, modifications, or/and variations, fall within the spirit of, and are encompassed by, the broad scope of the appended claims.

The invention claimed is:

1. An apparatus, comprising:

(a) a motor;

(b) a rotatable hub coupled to the motor;

(c) at least one fan blade comprising: i. a blade first end coupled to the rotatable hub, ii. a blade second end, iii. a leading edge, iv. a trailing edge, v. a passage extending from the blade first end to the blade second end, and vi. a winglet attached to the blade second end; and (d) at least one flexible strap extending through the passage of the at least one fan blade, and wherein the at least one flexible strap is coupled at a strap first end to the rotatable hub by way of a first coupling, and wherein the at least one flexible strap is further coupled at a strap second end to the winglet by way of a second coupling; and wherein the winglet includes a winglet anchor including an inner extension within the passage for coupling to the at least one flexible strap, said winglet anchor further including a perimeter extension configured to fit around an exterior of the at least one fan blade;

wherein the strap second end connects to the winglet anchor to form the second coupling, said second coupling being positioned within the passage; and wherein the inner extension is configured to form an anchor point for the at least one flexible strap at the strap second end, and wherein at least one fastener passes through the anchor point in a direction transverse to a longitudinal axis of the at least one fan blade.

2. The apparatus of claim 1, wherein the inner extension extends from an inside face of the winglet.

3. The apparatus of claim 1, wherein the inner extension extends parallel to a longitudinal axis of the at least one flexible strap.

4. The apparatus of claim 1, wherein the rotatable hub includes a hub anchor configured to provide an attachment point for the at least one flexible strap at the strap first end.

5. The apparatus of claim 4, wherein the hub anchor includes a threaded insert.

6. The apparatus of claim 5, wherein at least one second fastener passes through the threaded insert in a direction transverse to a longitudinal axis of the at least one fan blade.

7. The apparatus of claim 1, wherein the at least one flexible strap has a first mounting bracket attached to the strap first end and a second mounting bracket attached to the strap second end.

8. The apparatus of claim 1, wherein the at least one fan blade comprises a plurality of fan blades, each of the plurality of fan blades coupled to the rotatable hub; and wherein the at least one flexible strap comprises a plurality of flexible straps, each of the plurality of flexible straps located in a respective passage of a respective one of the plurality of fan blades, and each of the plurality of flexible straps coupled at a respective strap first end to the rotatable hub and coupled at a respective strap second end to an extension of the winglet within the respective passage.

9. An apparatus for connecting with a fan blade of a fan, comprising:

a connector including a first end and a second end; and a winglet configured to couple with the fan blade, the winglet including an extension configured to connect with the first end of the connector to form a first connection between the connector and the winglet, wherein the first connection is located at least partially within the cavity of the fan blade, wherein the first connection is adapted to secure the winglet to the fan, and wherein the first connection between the connector and the winglet comprises at least one fastener;

wherein the connector passes through the cavity of the fan blade from a first end of the fan blade to a second end of the fan blade, and the second end of the connector connects to a central hub of the fan via a direct interface with the central hub.

10. The apparatus of claim 9, wherein the extension extends from an inner portion of the winglet.

11. A fan including a plurality of the apparatuses of claim 9.

12. An apparatus for a fan including a motor and a rotatable hub rotatably coupled to the motor, comprising:

(a) a plurality of fan blades, each fan blade of the plurality of fan blades having a passage extending from a first end of the fan blade to a second end of the fan blade;

(b) a winglet attached to the second end of each fan blade; and (c) at least one connector comprising a flexible strap, said at least one connector extending through the passage of each fan blade and coupled to an inner portion of the winglet by a removable fastener to form a connection between the at least one connector and the winglet, wherein said connection is located within the passage.

* * * * *